US006921878B2

(12) United States Patent
Liao

(10) Patent No.: US 6,921,878 B2
(45) Date of Patent: Jul. 26, 2005

(54) WARMTH-KEEPING STRUCTURE OF COLD CATHODE LAMP

(75) Inventor: Shu Wei Liao, Pa-Teh (TW)

(73) Assignee: Ado Enterprise Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/357,468

(22) Filed: Feb. 4, 2003

(65) Prior Publication Data

US 2004/0149712 A1 Aug. 5, 2004

(51) Int. Cl.[7] ..... H05B 1/00

(52) U.S. Cl. ..... 219/220; 219/528; 219/529; 219/549

(58) Field of Search ..... 219/543, 390, 219/535, 553, 220, 528, 529, 549, 201, 209; 392/407; 315/56, 104.3, 291, 249; 362/31, 216, 223, 347, 26; 313/19, 581, 15, 25, 493; 337/405

(56) References Cited

U.S. PATENT DOCUMENTS

| | | | | | |
|---|---|---|---|---|---|
| 4,931,685 | A | * | 6/1990 | Dobashi et al. | 313/15 |
| 4,954,685 | A | * | 9/1990 | Kumagai et al. | 219/390 |
| 5,140,221 | A | * | 8/1992 | Ichinose | 313/581 |
| 5,142,191 | A | * | 8/1992 | Blaisdell et al. | 313/488 |
| 5,296,669 | A | * | 3/1994 | Kobayashi et al. | 219/201 |
| 5,905,339 | A | * | 5/1999 | Chow et al. | 313/631 |
| 5,964,515 | A | * | 10/1999 | Ikeuchi et al. | 362/26 |
| 6,037,854 | A | * | 3/2000 | Baker et al. | 337/405 |
| 6,057,635 | A | * | 5/2000 | Nishimura et al. | 313/25 |
| 6,302,995 | B1 | * | 10/2001 | Tanaka et al. | 156/345.36 |
| 6,316,872 | B1 | * | 11/2001 | Ge et al. | 313/493 |
| 6,376,816 | B2 | * | 4/2002 | Cooper et al. | 219/543 |
| 6,433,319 | B1 | * | 8/2002 | Bullock et al. | 219/543 |
| 6,441,874 | B1 | * | 8/2002 | Saito et al. | 349/70 |

FOREIGN PATENT DOCUMENTS

| | | | | |
|---|---|---|---|---|
| DE | DD251646 | * | 11/1987 | H01F/41/04 |
| DE | 19735132 | * | 2/1998 | H01J/61/52 |
| JP | 02010682 | * | 6/1990 | H05B/3/00 |
| JP | 2002083571 | * | 3/2002 | H01J/61/52 |

* cited by examiner

*Primary Examiner*—Robin O. Evans
*Assistant Examiner*—Leonid M Fastovsky
(74) *Attorney, Agent, or Firm*—Browdy and Neimark, P.L.L.C.

(57) ABSTRACT

A warmth-keeping structure of cold cathode lamp comprises a cold cathode lamp, a soft electric heating component and two insulating components. The soft electric heating component is wound around the surface of the cold cathode lamp. Two ends of the soft electric heating component are joined at two sides of the cold cathode lamp with the two insulating components slipped onto the joint portions, respectively. Through holes are formed on the insulating components so that different power sources can be provided for the soft electric heating component and the cold cathode lamp via conducting wires. The soft electric heating component can heat the cold cathode lamp in advance before the cold cathode lamp radiates to let the cold cathode lamp raise its ambient temperature in a few seconds and keep a fixed working temperature, hence stabilizing the brightness thereof and dissipating less power.

5 Claims, 4 Drawing Sheets

WARMTH-KEEPING STRUCTURE OF COLD CATHODE LAMP

FIELD OF THE INVENTION

The present invention relates to a warmth-keeping structure of cold cathode lamp and, more particularly, to a structure capable of keeping a cold cathode lamp thereof warm.

BACKGROUND OF THE INVENTION

In a cold cathode lamp (e.g., a cold cathode fluorescent lamp (CCFL)) used in a scanner, mercury atoms are excited to radiate out ultraviolet (UV) lights, which then let fluorescent material emit out visible lights.

As shown in FIG. 2, a cold cathode lamp 60 is formed by coating fluorescent lacquer on part of the inward wall of a lamp 61 made of quartz. Reflecting coating layers 62 and 63 are then deposited or added on the lamp 61 to let the cold cathode lamp have a directionality. All light emitted by the cold cathode lamp 60 will be radiated out via a radiation aperture provided by the reflecting coating layers 62 and 63.

As shown in FIG. 1, when the cold cathode lamp 60 is assembled in a scanner 50, a plurality of tabular or tubular pre-heaters 70 are provided near the cold cathode lamp 60 to heat the cold cathode lamp 60 in advance. Or the pre-heaters 70 are provided near the surface of the opposed side of the document-read position.

In this way, however, the assembly cost of the cold cathode lamp 60 and the pre-heaters 70 will be increased.

Moreover, because the cold cathode lamp 60 is unstable at low temperatures, the brightness thereof will be unstable until a certain time elapses.

Furthermore, the pre-heaters 70 and the cold cathode lamp 60 are powered by the same power source after the scanner 50 is activated, hence dissipating more power.

Accordingly, the present invention aims to provide a warmth-keeping structure of cold cathode lamp to resolve the problems in the prior art.

SUMMARY OF THE INVENTION

The object of the present invention is to provide a warmth-keeping structure of cold cathode lamp, wherein a soft electric heating component is used to heat a cold cathode lamp in advance before the cold cathode lamp radiates. The cold cathode lamp can thus raise its ambient temperature in a few seconds and keep a fixed working temperature, hence stabilizing the brightness thereof and dissipating less power.

To achieve the above object, a soft electric heating component is wound around the surface of the cold cathode lamp. Two ends of the soft electric heating component are joined at two sides of the cold cathode lamp with two insulating components slipped onto the joint portions, respectively. Through holes are formed on the insulating components so that different power sources can be provided for the soft electric heating component and the cold cathode lamp via conducting wires.

The various objects and advantages of the present invention will be more readily understood from the following detailed description when read in conjunction with the appended drawing, in which:

DETAILED DESCRIPTION OF THE PREFERRED EMBODIMENTS

Figure 1:
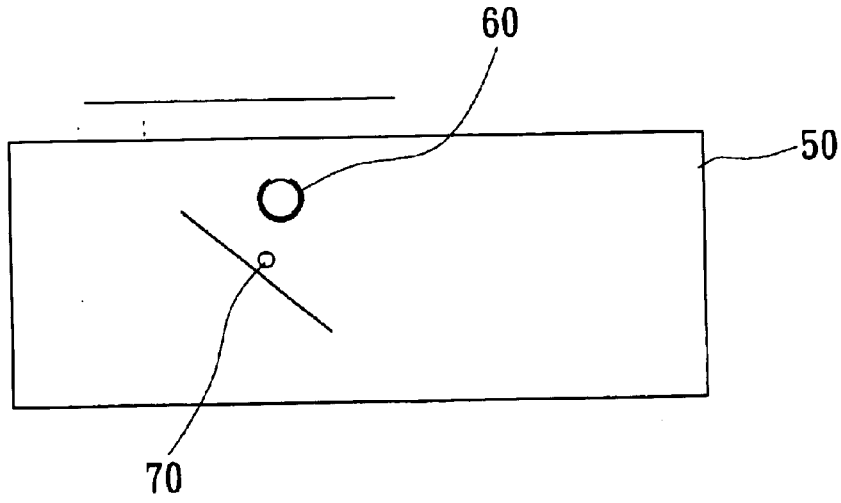
FIG. 1 PRIOR ART
FIG. 1 is an assembly diagram of a conventional scanner.
Figure 2:
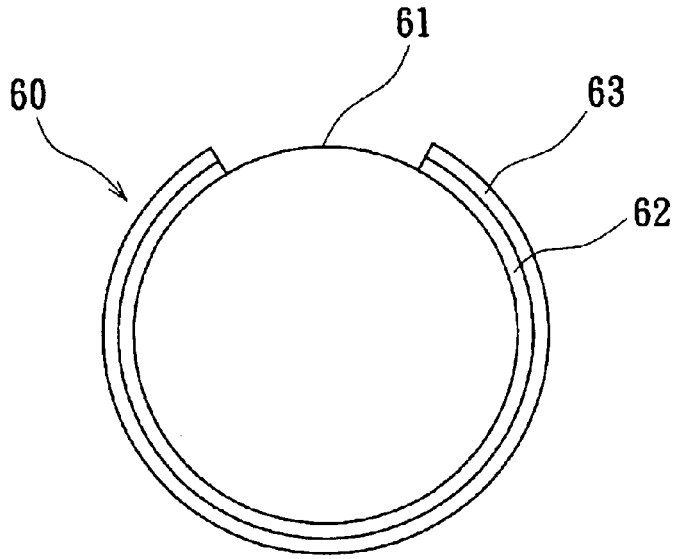
FIG. 2 PRIOR ART
FIG. 2 is an assembly diagram of a conventional cold cathode lamp.
Figure 3:
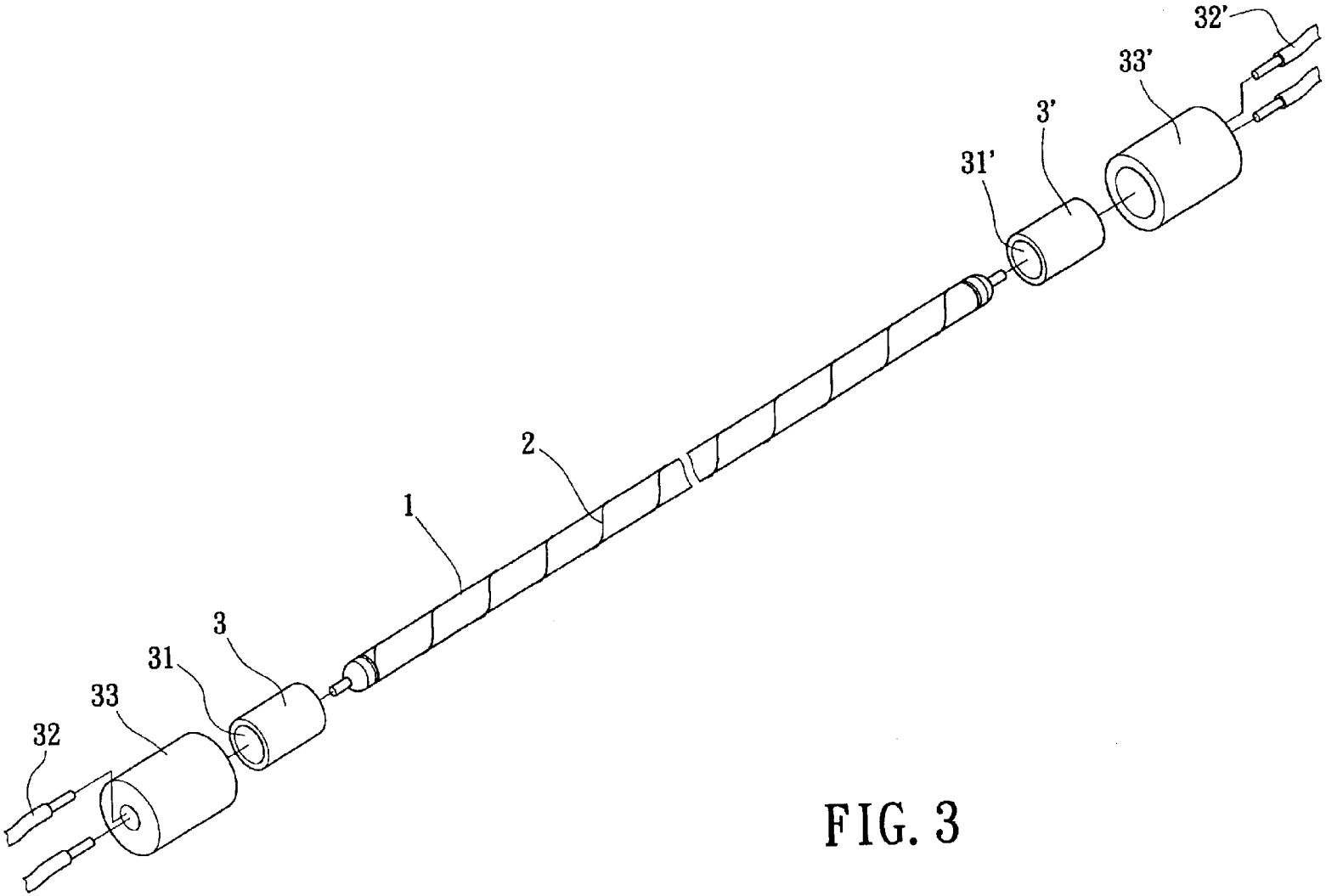
FIG. 3 is an exploded perspective view of the present invention.
Figure 4:
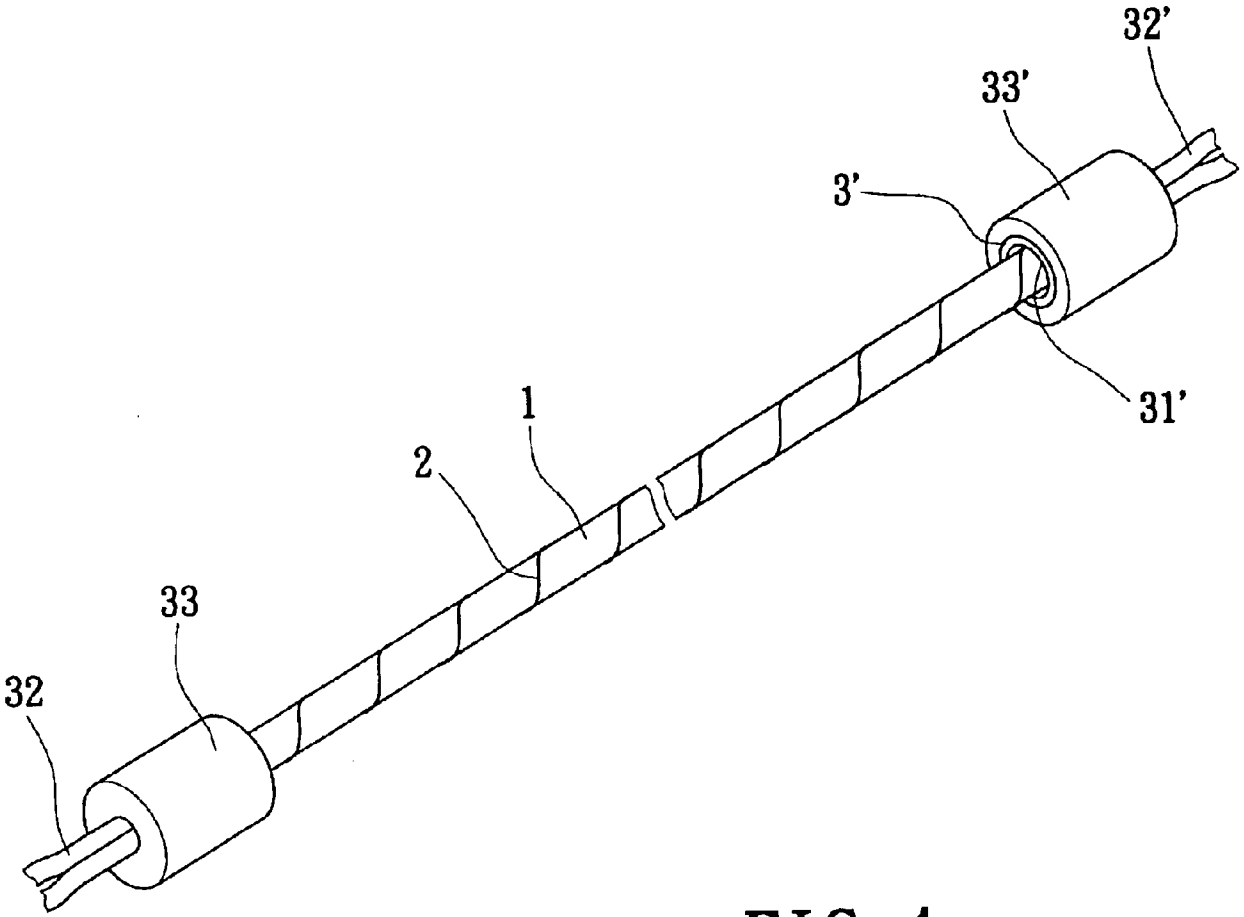
FIG. 4 is an perspective assembly view of the present invention.
Figure 5:
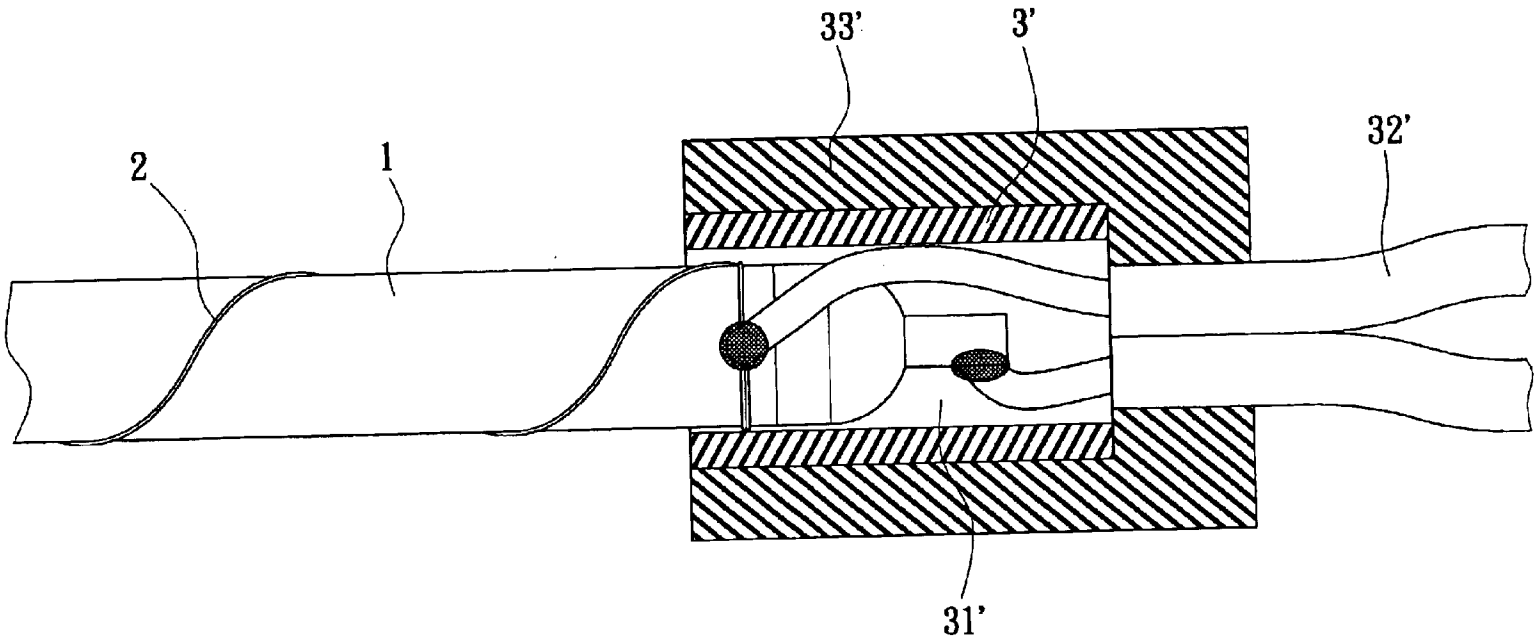
FIG. 5 is a partial cross-sectional view of the present invention.

As shown in FIGS. 3 to 5, a warmth-keeping structure of cold cathode lamp of the present invention used in a scanner comprises a cold cathode lamp 1, a soft electric heating component 2 and two insulating components 3 and 3'.

The cold cathode lamp 1 is a cold cathode light source containing mercury, and is powered by a first power source to radiate. The length of the cold cathode lamp 1 is longer than the width thereof.

In this embodiment, the soft electric heating component 2 is a soft electric heating filament, which is wound around the surface of the cold cathode lamp 1. Two sides of the soft electric heating component 2 adhere to two sides of the cold cathode lamp 1 by means of agglutination. The soft electric heating component 2 is powered by a second power source and heats in advance before the cold cathode lamp 1 radiates.

The insulating components 3 and 3' are respectively joined at the joint portions at two sides of the electric heating component 2 and the cold cathode lamp 1. In this embodiment, the joint is accomplished by means of point agglutination. Each of the insulating components 3 (3') has a through hole 31 (31') so that two conducting wires 32 (32') can be connected to one end of the soft electric heating component 2 and the cold cathode lamp 1 via a hollow plastic cladding 33 (33').

The soft electric heating component 2 can be powered by the second power source to work before the cold cathode lamp 1 radiates. That is, the soft electric heating component 2 can heat in advance to increase the surface temperature of the cold cathode lamp 1, hence letting the cold cathode lamp 1 keep at a fixed working temperature.

The soft electric heating component 2 can also be replaced with a soft electric heating sheet or another electric heating component having the same effect.

To sum up, through the structure design of the present invention, a soft electric heating component can heat in advance before a cold cathode lamp radiates to let the cold cathode lamp raise its ambient temperature in a few seconds and keep a fixed working temperature, hence stabilizing the brightness thereof and dissipating less power.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A warmth-keeping structure of cold cathode lamp used in a scanner, comprising:

a cold cathode lamp powered by a first power source to radiate;

a soft electric heating component wound around the surface of said cold cathode lamp, two ends of said soft electric heating component being respectively joined at two sides of said cold cathode lamp, said soft electric heating component being powered by a second power source to heat in advance;

wires connecting the second power source to the soft electric heating component at both ends of the component at two junctions located at respective ends of the soft electric heating component; and two insulating components respectively joined at the joint portions at the two sides of said electric heating component and said cold cathode lamp, and the heating component is a soft electric heating sheet, the heating sheet being connected to the insulating components at both sides of the cold cathode lamp such that the insulating components cover the two junctions for the soft electric heating component and the wires;

wherein the soft electric heating component is wound from one side of the cold cathode lamp to the other side; and whereby the ambient temperature of said cold cathode lamp can be raised before the cold cathode lamp radiates by heating the soft electric heating sheet.

2. The warmth-keeping structure of cold cathode lamp as claimed in claim 1, wherein the two ends of said soft electric heating component adhere to said cold cathode lamp by means of agglutination.

3. The warmth-keeping structure of cold cathode lamp as claimed in claim 1, wherein through holes are provided on said insulating components so that different power sources can be provided for said soft electric heating component and said cold cathode lamp via conducting wires.

4. The warmth-keeping structure of cold cathode lamp as claimed in claim 1, wherein a hollow plastic cladding can be slipped onto the surface of each of said insulating components.

5. A warmth-keeping structure of cold cathode lamp used in a scanner, comprising:

a cold cathode lamp powered by a first power source to radiate;

a soft electric heating component wound around the surface of said cold cathode lamp, two ends of said soft electric heating component being respectively joined at two sides of said cold cathode lamp, said soft electric heating component being powered by a second power source to heat in advance; wires connecting the second power source to the soft electric heating component at both ends of the component at two junctions located at respective ends of the soft electric heating component; and two insulating components respectively joined at the joint portions at the two sides of said electric heating component and said cold cathode lamp, and the heating component is a soft electric heating sheet, the heating sheet being connected to the insulating components at both sides of the cold cathode lamp such that the insulating components cover the two junctions for the soft electric heating component and the wires;

wherein the soft electric heating component is wound from one side of the cold cathode lamp to the other side by a spiral path; and whereby the ambient temperature of said cold cathode lamp can be raised before the cold cathode lamp radiates by heating the soft electric heating sheet.

* * * * *